United States Patent [19]

Aleman

[11] Patent Number: 4,637,535

[45] Date of Patent: Jan. 20, 1987

[54] CARRYING STRAP FOR CAMERAS AND THE LIKE

[76] Inventor: Javier Aleman, 1146 Fourth St., Stone Mountain, Ga. 30083

[21] Appl. No.: 782,373

[22] Filed: Oct. 1, 1985

[51] Int. Cl.[4] ..... A45F 3/02

[52] U.S. Cl. ..... 224/202; 224/206; 224/257; 224/908; 224/909

[58] Field of Search ..... 224/908, 909, 150, 158, 224/159, 160, 202, 205, 206, 257

[56] References Cited

U.S. PATENT DOCUMENTS

| | | | |
|---|---|---|---|
| 3,326,430 | 6/1967 | Banks | 224/908 X |
| 3,602,409 | 8/1971 | Kerns | 224/908 X |
| 4,320,863 | 3/1982 | Lyer et al. | 224/908 X |

FOREIGN PATENT DOCUMENTS

| | | | |
|---|---|---|---|
| 666265 | 10/1938 | Fed. Rep. of Germany | 224/908 X |

*Primary Examiner*—Stephen Marcus
*Assistant Examiner*—David Voorhees
*Attorney, Agent, or Firm*—James B. Middleton

[57] ABSTRACT

A carrying strap for cameras for providing a secure carrying position for the camera. The strap uses the generally conventional strap for suspending the camera in the abdominal area of the person so the camera is readily available for use, and an additional strap is fixed to the camera, or to the ends of the usual strap. The additional strap is of the right length for the person's arm to pass through the strap and carry the camera from the person's shoulder. In this position, the usual strap urges the camera towards the person's body and the person's upper arm can hold the camera. Also, a securing strap extends from the usual strap to the additional strap to prevent the additional strap from slipping off the shoulder.

5 Claims, 4 Drawing Figures

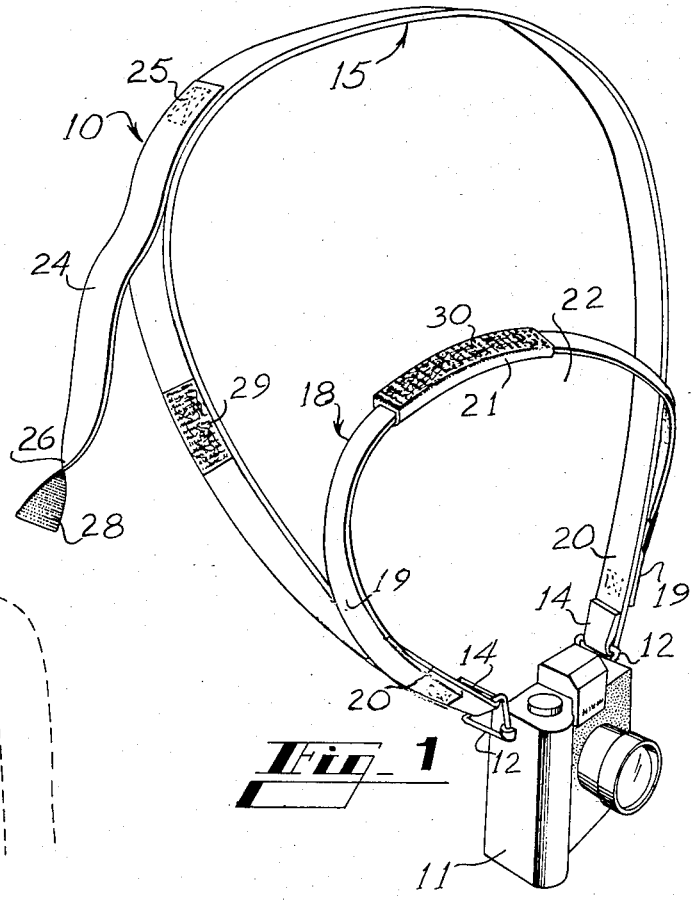
Fig_1
Fig_2
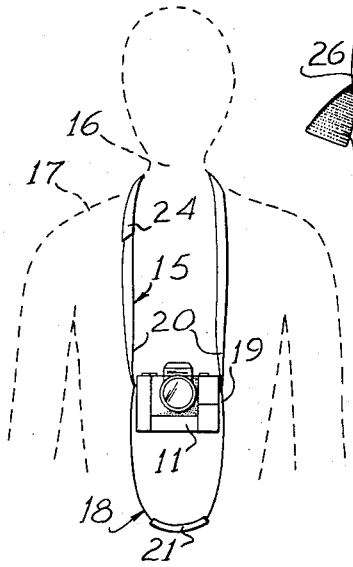
Fig_3
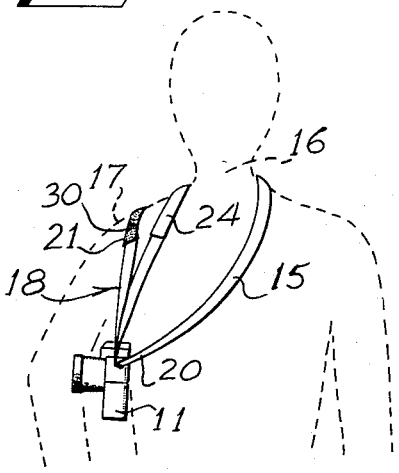
Fig_4
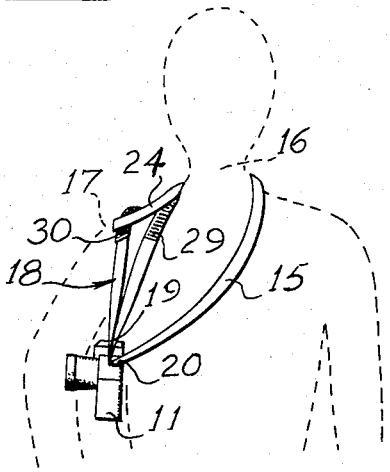

CARRYING STRAP FOR CAMERAS AND THE LIKE

INFORMATION DISCLOSURE STATEMENT

There have been several forms of straps and other carrying arrangements for cameras and the like in an effort to have a camera available for use but to render transport reasonably safe and comfortable. Prior carrying straps have normally included various strap and elastic band arrangements that pass around the body of the person to hold the camera directly against the body, but to allow use of the camera, though sometimes with difficulty. The primary alternative to such an arrangement is simply to carry the camera on a conventional strap, utilizing various techniques for holding the camera, or to place the camera in a camera bag where it is protected. While there are numerous camera bags that are designed for convenience of use, the camera is not readily available when in a bag; and, a photographer may not wish to carry a bag when only a small amount of equipment is needed.

SUMMARY OF THE INVENTION

This invention relates generally to carrying straps, and is more particularly concerned with a camera strap including an auxiliary strap means for securing the camera for transport.

The present invention provides, for use on a camera or the like, a principal carrying strap that is long enough to provide for easy use of the camera, and an auxiliary strap means for supporting the camera in a secure position from the person's shoulder. The principal strap serves to hold the auxiliary strap means on the shoulder, and an additional securing strap may be provided for use when desired.

BRIEF DESCRIPTION OF THE DRAWINGS

These and other features and advantages of the present invention will become apparent from consideration of the following specification when taken in conjunction with the accompanying drawings in which:

FIG. 1 is a perspective view of a carrying strap made in accordance with the present invention, the strap being shown carrying a camera;

FIG. 2 is a front elevational view illustrating the apparatus of FIG. 1 in position so the camera is ready for use;

FIG. 3 is a view similar to FIG. 2 but showing the auxiliary strap means over the shoulder in transport position; and, FIG. 4 is a view similar to FIG. 3 but showing the securing strap in use.

DETAILED DESCRIPTION OF THE EMBODIMENT

Referring now more particularly to the drawings, and to that embodiment of the invention here presented by way of illustration, it will be seen that FIG. 1 illustrates a strap assembly generally designated at 10 attached to a camera 11. The camera 11 is here shown as including triangular connecting rings 12, and the strap assembly 10 is folded around the ring 12 as at 14. Those skilled in the art will realize that various cameras utilize various connection means, and the one here shown is by way of illustration only. Those skilled in the art will readily substitute connection means to suit the individual and the camera being used.

Considering also FIG. 2 of the drawings, those skilled in the art will understand that the principal strap 15 acts in the same way as a conventional camera strap in that the strap 15 is connected to the two sides of the camera 11, the strap 15 passes around the neck 16 of the person carrying the camera, and the camera 11 is held generally in the abdominal area of the person. The strap 15 is therefore long enough that the photographer can grasp the camera and raise it to his eyes without further manipulation of the strap. When the camera 11 is temporarily not in use, the camera can be lowered, and again be suspended in the abdominal area of the person.

It will also be understood that the above described process constitutes one of the problems with the conventional carrying straps. When a person is walking, or especially running, climbing or the like, the camera 11 suspended from the rather lengthy strap 15 tends to hit the person and/or surrounding objects, which is hazardous to both the person and the camera. The difficulty has therefore been in the devising of some means for rendering the camera temporarily secure while having the camera readily available for use.

The present invention provides the auxiliary strap means generally designated at 18. In FIG. 1, the auxiliary strap 18 is shown above the camera, as in position to support the camera, while in FIG. 2 the auxiliary strap 18 is shown in the position it will take during normal transport of the camera. The auxiliary strap 18 is flexible, so the strap will tend to fall downwardly as shown in FIG. 2. The strap 18 will therefore not be in a position to interfere with normal use of the camera 11.

In FIG. 1 it will be noted that the ends 19 of the auxiliary strap 18 are fixed to the ends 20 of the strap 15. While this arrangement is quite effective, it will also be understood that the important feature is to provide the auxiliary strap 18, and the ends 19 of the strap 18 could be connected directly to the rings 12 or otherwise fixed with respect to the camera 11.

Referring now to FIGS. 1 and 3, it should be understood that the auxiliary strap means 18 is designed to be slipped over the shoulder of a person carrying the camera 11. It is important to note that the strap 15 remains around the neck 16 of the person, and one can simply grasp the shoulder pad 21 of the auxiliary strap means 18 to support the camera 11, and the person's hand and arm can be slipped through the loop defined at 22. This motion continues until the shoulder pad 21 is in position on the shoulder 17 of the person carrying the camera.

Since the principal strap 15 remains attached to the camera 11, and remains around the neck 16 of the person, it will be noted that the strap 15 will exert a force tending to urge the camera 11 against the body of the person. The primary weight of the camera 11 has now been transferred to the shoulder of the person, the person's arm will tend to hold the camera 11 against the person's body, and the strap 15 further serves to hold the camera in position. It will therefore be understood that the transport position shown in FIG. 3 is very comfortable and secure for both the person and the camera. It will also be understood, however, that the camera 11 is readily useable. Since the strap 15 remains around the neck 16 of the person, one can quickly slip the auxiliary strap 18 off the shoulder 17, and the camera is returned to the position shown in FIG. 2, ready for use.

Looking next at FIGS. 1 and 4, it will first be seen that there is a securing strap 24 fixed at one end 25 to the principal strap 15. The opposite end 26 of the securing strap 24 is releasably attachable to the strap 15, and selectively attachable to the auxiliary strap means 18. As here shown, hook and teasel material is utilized for the releasable connections, though those skilled in the art will readily substitute snaps, hooks or the like depending on personal preferences.

In utilizing the hook and teasel material, it is contemplated that hook material will be placed on the end 26 of the securing strap 24, the hook material being designated at 28. When the securing strap 24 is in a stored position lying along the strap 15, the hook material 28 will be engaged with the teasel material 29 which is fixed to the strap 15. Thus, when the securing strap 24 is not in use, the securing strap 24 will be held along the strap 15 and will not interfere with use of the strap assembly 10.

Looking then at FIG. 4 along with FIG. 1, it will be seen that the auxiliary strap means 18 also includes teasel material designated at 30. The teasel material 30 is here shown as being on the shoulder pad 21. While the shoulder pad 21 is of course optional, the teasel material is appropriately placed at the apex of the auxiliary strap 18 when the strap 18 is in use. Thus, as is shown in FIG. 4, when a person desires to transport the camera for an extended period, or wishes to do extensive climbing, crawling through brush or the like, the securing strap 24 can be released from the teasel material 29, and the hook material 28 can be engaged with the teasel material 30. With this connection, there is an additional, positive holding force to prevent the auxiliary strap 18 from slipping off the shoulder 17 of the person. Nevertheless, when the camera is to be used, the securing strap 24 is readily released from the auxiliary strap 18, and the auxiliary strap 18 can be removed from the shoulder 17 so the camera is again in the position shown in FIG. 2, ready for use.

While it is obvious that the hook material and teasel material can be reversed, it is preferable that the teasel material be uppermost when the material is exposed as is shown in FIGS. 3 and 4. It will be understood that the hook material will readily become entangled with a person's hair whereas the teasel material is soft and inoffensive.

It will therefore be understood that the present invention provides an extremely simple strap assembly for a camera or the like, the principal strap being useable in a conventional fashion to have a camera suspended from a person's neck and ready for easy use without adjustment. An auxiliary strap is carried by the same assembly, and will normally be suspended from the camera to be in a position not to interfere with normal use of the camera. When the person desires to render the camera somewhat more secure, the auxiliary strap can be placed over the person's shoulder, and the principal strap will tend to hold the camera against the person's body while the person's arm assists in rendering the camera secure. If desired, an additional securing strap can extend from the primary strap to the auxiliary strap for securing the auxiliary strap in place on the person's shoulder.

It will of course be understood that the principal strap can be of any conventional material, and any conventional design. Thus, leather, knit webbing and other conventional strap materials may be utilized. Also, as is conventional, various quick release buckles and strap takeup buckles can be included, all as well known to those skilled in the art.

It will therefore be obvious that the particular embodiment of the invention here presented is by way of illustration only, and is meant to be in no way restrictive; therefore, numerous changes and modifications may be made, and the full use of equivalents resorted to, without departing from the spirit or scope of the invention as defined in the appended claims.

I claim:

1. A carrying strap assembly for camera and the like, said strap assembly comprising a principal strap for suspending said camera around the neck of a person so that said camera is in position for easy use, and an auxiliary strap means for supporting said camera in a secure position for transport of said camera, said principal strap including a first strap having a first end and a second end connected to said camera for supporting said camera, said first strap being long enough to pass around the neck of the person carrying the camera and to support said camera in an easy use position, said auxiliary strap means including a second strap having a first end and a second end fixed with respect to said camera, said first end and said second end of said second strap being adjacent to said first end and said second end of said first strap, said second strap being shorter than said first strap and having an appropriate length for supporting said camera from said person's shoulder and securing said camera beneath said person's arm, and further including a securing strap, said securing strap having a first end fixed to said first strap and a second end relasably fixable to said first strap, said securing strap being selectively releasably fixable to said second strap for holding said auxiliary strap means with respect to said principal strap.

2. A carrying strap as claimed in claim 1, said securing strap normally lying along said first strap, and including hook material on said second end of said securing strap, teasel material on said first strap located for engagement by said hook material, and second teasel material on said second strap for selective engagement with said hook material on said securing strap.

3. A carrying strap as claimed in claim 2, said second strap further including a shoulder pad slidable along said second strap, said second teasel material being carried by said shoulder pad.

4. In a camera carrying strap comprising a first strap having a first end and a second end, means for connecting said first end of said strap to one side of said camera and connecting said second end of said strap to the other side of said camera, said first strap having sufficient length for passing around the neck of the person carrying the camera and for disposing said camera in an easy use position with respect to said person, the arrangement being such that the back of the person's neck carries the weight of said camera, the combination therewith of auxiliary strap means including a second strap having a first end and a second end, said first end of said second strap being fixed adjacent to said first end of said first strap, and said second end of said second strap being fixed adjacent to said second end of said first strap, said second strap having sufficient length for passing over the shoulder of said person and for disposing said camera under the arm of said person in a secure position while said first strap remains around the neck of said person, the arrangement being such that said first strap urges said camera towards said person while the shoulder of said person carries the weight of said camera, said second strap being flexible so that said second strap hangs below said camera when said camera is suspended by said first strap in said easy use position, said second strap selectively defining a loop for receiving said person's arm therethrough, said auxiliary strap means further including securing means for selectively holding said second strap on the shoulder of said person, said securing means including a securing strap having a first end fixed to said first strap and a second end selectively releasably fixable to said second strap when said second strap is on the shoulder of said person.

5. In a camera carrying strap as claimed in claim 4, said securing means further including releasable means for selectively fixing said second end of said securing strap to said first strap so that said securing strap lies along said first strap.

* * * * *